US005689795A

United States Patent [19]

Mastrandrea

[11] Patent Number: 5,689,795

[45] Date of Patent: Nov. 18, 1997

[54] SHEET TRANSFER APPARATUS WITH ADAPTIVE SPEED-UP DELAY

[75] Inventor: Jane F. Mastrandrea, Webster, N.Y.

[73] Assignee: Xerox Corporation, Stamford, Conn.

[21] Appl. No.: 719,269

[22] Filed: Sep. 24, 1996

[51] Int. Cl.[6] ..... G03G 21/00

[52] U.S. Cl. ..... 399/407; 399/397; 399/401; 271/202

[58] Field of Search ..... 399/397, 400, 399/405, 407, 401; 271/202, 203, 314

[56] References Cited

U.S. PATENT DOCUMENTS

| | | | |
|---|---|---|---|
| 3,564,960 | 2/1971 | Foulks | 83/203 |
| 4,427,287 | 1/1984 | Matsumoto et al. | 355/14 SH |
| 4,579,444 | 4/1986 | Pinckney et al. | 355/14 SH |
| 4,785,325 | 11/1988 | Kramer et al. | 355/8 |
| 4,892,426 | 1/1990 | Steele | 400/708 |
| 5,337,135 | 8/1994 | Malachowski et al. | 399/401 |
| 5,423,527 | 6/1995 | Tranquilla | 271/10 |
| 5,461,468 | 10/1995 | Dempsey et al. | 355/316 |

*Primary Examiner*—R. L. Moses
*Attorney, Agent, or Firm*—John S. Wagley

[57] ABSTRACT

A printing apparatus including a processing section for transferring a developed image onto a copy sheet and a finishing section for receiving plural copy sheets to generate a print set is disclosed. The apparatus includes a first sheet feeding apparatus associated with the processing section for feeding the sheets through the processing station at a first translational speed and a second sheet feeding apparatus associated with the finishing section for feeding the sheets to the finishing section at a second translational speed. The apparatus also includes a sheet transfer apparatus for transferring the sheets from the first sheet feeding apparatus to the second sheet feeding apparatus, for changing the speed of the sheets from the first translational speed to the second translational speed and for positioning adjacent sheets in the second feeding apparatus in a spaced apart relationship therebetween defining a space between adjacent sheets. The apparatus further includes a controller operably connected to the sheet transfer apparatus for controlling the feeding of sheets through the sheet transfer apparatus to permit the space to be selectively determined.

20 Claims, 6 Drawing Sheets

SHEET TRANSFER APPARATUS WITH ADAPTIVE SPEED-UP DELAY

This invention relates to electrostatographic printing machines, and, more particularly, to an electrostatographic printing system having a finishing station.

Generally, the process of electrostatographic reproduction is executed by exposing a light image of an original document to a substantially uniform charged photoreceptive member. Exposing the charged photoreceptive member to a light image discharges the photoconductive surface thereof in areas corresponding to non-image areas in the original document while maintaining the charge on the image areas to create an electrostatic latent image of the original document on the photoconductive surface of the photoreceptive member. The latent image is subsequently developed into a visible image by depositing a charged developing material onto the photoconductive surface so that the developing material is attracted to the charged image areas thereon. The developing material is then transferred from the photoreceptive member to an output copy sheet on which the image may be permanently affixed in order to provide a reproduction of the original document. In a final step in the process, the photoreceptive member is cleaned to remove any residual developing material on the photoconductive surface thereof in preparation for successive imaging cycles.

The electrostatographic copying process described above is well known and is commonly used for light lens copying of an original document. Analogous processes also exist in other electrostatographic printing applications such as, for example, ionographic printing and reproduction, where charge is deposited on a charge retentive surface in response to electronically generated or stored images.

The primary output product for a typical electrostatographic printing system is a printed copy substrate such as a sheet of paper bearing printed information in a specified format. Quite often, customer requirements necessitate that this output product be configured in various specialized arrangements or in print sets ranging from stacks of collated loose printed sheets to tabulated and bound booklets.

The stacks of collated, loose printed sheets are often permanently affixed together in sets. For example, the collated, loose printed sheets may be stapled together or bound together by means of glue or other adhesive. The binding or stapling of the sets of printed sheets typically and preferably occurs during the operation of the printing machine. Applying adhesive or stapling the sheets and transferring the set of sheets to a position where the stapling and/or the gluing can occur, must be done during the printing cycle or in "real" time when utilizing the printing machine. The added time to staple or bind may be accommodated by stopping the printing of the machine during the stapling and binding process. Such interruption of the machine during stapling and binding greatly reduces the capacity of high speed printing machines.

One solution to this problem is to add a bin sorter to the machine where sets of collated, loose printed sheets are gathered and prepared for the stapling and binding within the finisher. For example, three sets of collated, loose printed sheets may be in queue for the finisher at any given time. The copy machine may then continue to operate, filling the sorter while the finisher grabs one of the sets of finished sheets within the bin sorter for finishing by way of stapling or binding. When utilizing a bin sorter, however, the copy sheets must be redirected when the exiting sheet changes from the last sheet of a first set to the first sheet of a next set of copies. To allow for the redirecting of the sheets from a first bin to a second bin, copy machines typically have what is know as a "skip" pitch. A skip pitch is a missing sheet or a plurality of missing sheets within the stream of copy paper through the printer. These skip pitches allow time for the mechanism within the bin sorter to readjust when moving from the last sheet of a first set of copies to the first sheet of a second set of copies to be later finished. The use of a skip pitch or skip pitches reduces the effective capacity of the machine when making copies utilizing a finisher.

The lost productivity when using a finisher because of moving one bin to another bin of a bin sorter, may be partially alleviated by accelerating the copy sheets when moving from the copy machine where the xerographic process is performed to the finishing section. The use of the accelerated speed in the finisher creates greater distances between adjacent sheets reducing somewhat the amount of skipped pitches required or missing sheets required between adjacent sets of output to be finished.

Even when using state of the art document producing and finishing apparatus, it may be necessary to insert sheets into the document which are produced by means other than the document producing apparatus, or produced at a separate time from the majority of the sheets contained in the print set. For example, it is not uncommon to place specially colored sheets, chapter dividers, photographs or other special insert sheets into a print set to product a final document. For example, it is common to use preprinted sheets which were produced by four-color offset press techniques as special insert sheets in a document containing mostly text printed on ordinary white paper. In another example, booklets produced from signatures, often use special cover sheets or center sheets containing, for example, coupons. It is generally not desirable to pass these sheets through the printer processing apparatus because the ink on the special insert sheets tends to be smudged by the paper-handling rollers, etc. of the document producing apparatus. In addition, these special insert sheets may be of a particular weight stock or may include protruding tabs which may cause jams when transported through the printer processor.

Accordingly, these special insert sheets must be inserted into the stream of sheets subsequent to processing in the printer processor section of the document producing apparatus. It is desirable to insert these sheets without disrupting the flow of the continuous stream of processed sheets. It is also desirable to insert these sheets in a manner which is transparent to the print processor on the finishing apparatus so that the operation of these apparatus need not be modified.

The adding of inserts within a finisher further compounds the capacity problem of the printing machine. Just as with the movement of a bin sorter to accommodate first and second sets of copies to be later finished, the addition of inserts to a set of copies to be sorted, further requires additional skip pitches to be added to the operation of the machine, further reducing the productivity thereof.

The following disclosures appear to be relevant:

U.S. Pat. No. 5,461,468

Patentee: Dempsey et al.

Issued: Oct. 24, 1995

U.S. Pat. No. 5,423,527

Patentee: Tranquilla

Issued: Jun. 13, 1995

U.S. Pat. No. 5,339,139

Patentee: Fullerton et al.

Issued: Aug. 16, 1994

U.S. Pat. No. 4,892,426

Patentee: Steele

Issued: Jan. 9, 1990

U.S. Pat. No. 4,785,325

Patentee: Kramer et al.

Issued: Nov. 15, 1988

U.S. Pat. No. 4,579,444

Patentee: Pinckney et al.

Issued: Apr. 1, 1986

U.S. Pat. No. 4,427,287

Patentee: Matsumoto et al.

Issued: Jan. 24, 1984

U.S. Pat. No. 3,564,960

Patentee: Foulks

Issued: Feb. 23, 1971

The relevant portions of the foregoing disclosures may be briefly summarized as follows:

U.S. Pat. No. 5,461,468 discloses a document handler interdocument gap control system. A first servo drive feeds document in a first path portion and a second servo drive feeds documents in the second path portion. A sheet edge sensor in the first path portion signal the passage of the lead or trail edge of document sheets.

U.S. Pat. No. 5,423,527 discloses a method of processing documents by moving them from an input hopper to a destination site at a controlled rate. The method includes driving each document into a feed path from the input hopper at an adjustable time period after a previous document has been feed, then sensing the distance separating the documents and adjusting the time period between driving of succeeding documents to achieve a desired gap.

U.S. Pat. No. 4,892,426 discloses a paper movement monitor for monitoring the movement of paper through a printer. The monitor includes sensors in the form of photo-optical wheels which are in rolling contact with the paper and sense the position of the paper.

U.S. Pat. No. 4,785,325 discloses a document imaging system including a mechanism for adjusting the speed ratio between the document scanning system and the photoreceptor. A timing belt is connected between an adjustable tapered portion of a drive pulley mounted on the photoreceptor drive shaft and the document scanning system. The portion of the tapered surface on which the belt is driven is axially adjustable resting in a change in scanning speed.

U.S. Pat. No. 4,579,444 discloses a document registration system for use in a document feeder of a copier. The registration system includes a control system for controlling document platen transport to stop at a desired calculated position. The system includes a sensor and upstream of the trailing edge of a document. The sensor provides a signal indicative of the size of the copy sheet and calculates a stopping position on the platen based on the selected copy reduction size.

U.S. Pat. No. 4,427,287 discloses a copying machine having an automatic document feeder. The copy machine has a single motor for driving a drive mechanism for the main body and a drive mechanism for the automatic document feeder. A timing disk is coupled to the motor for supplying a timing signal. Based on this signal, a CPU controls the operation of the copy machine.

U.S. Pat. No. 3,564,960 discloses a copy machine copy paper length error compensating system. As an original moves forward, a trailing edge sensor sends an initial cutting signal to a super-precise electronic timer having a capacitor. The charging interval of the capacitor is controlled to maintain cut length of the sheet.

As will be seen from an examination of the cited prior art, it is desirable to provide an electrostatographic copying system with a maximum throughput at the finishing station. The transition from a first set of sheets to be finished or a second or subsequent set of sheets to be finished results in a lower productivity to account for handling required for the various sets of sheets. This invention is directed to reduce the lost productivity between adjacent sets of sheets and thereby to improve the throughput out the finishing station and the effective capacity of the printing machine.

In accordance with one aspect of the invention, there is provided a printing apparatus including a processing section for transferring a developed image onto a copy sheet and a finishing section for receiving plural copy sheets to generate a print set. The apparatus includes a first sheet feeding apparatus associated with the processing section for feeding the sheets through the processing station at a first translational speed and a second sheet feeding apparatus associated with the finishing section for feeding the sheets to the finishing section at a second translational speed The apparatus also includes a sheet transfer apparatus for transferring the sheets from the first sheet feeding apparatus to the second sheet feeding apparatus, for changing the speed of the sheets from the first translational speed to the second translational speed and for positioning adjacent sheets in the second feeding apparatus in a spaced apart relationship therebetween defining a space between adjacent sheets. The apparatus further includes a controller operably connected to the sheet transfer apparatus for controlling the feeding of sheets through the sheet transfer apparatus to permit the space to be selectively determined.

In accordance with another aspect of the present invention, there is provided a printing apparatus including a processing section for transferring a developed image onto a copy sheet and a finishing section for receiving plural copy sheets to generate a print set. The apparatus includes a first sheet feeding apparatus associated with the processing section for feeding the sheets through the processing station at a first translational speed and a second sheet feeding apparatus associated with the finishing section for feeding the sheets to the finishing section at a second translational speed. The first translational speed is greater than the second translational speed. The apparatus also includes a sheet transfer apparatus for transferring the sheets from the first sheet feeding apparatus to the second sheet feeding apparatus, for changing the speed of the sheets from the first translational speed to the second translational speed and for positioning adjacent sheets in the second feeding apparatus in a spaced apart relationship therebetween defining a space between adjacent sheets. The sheet transfer apparatus includes a mechanism for accelerating the sheets from the first translational speed to the second translational speed. The mechanism cooperates with the second sheet feeding apparatus to position adjacent sheets in the second feeding apparatus. The mechanism includes a driver engaged with the sheet for accelerating the sheet from the first translational speed to the second translational speed. The apparatus also includes a controller operably connected to the sheet transfer apparatus for controlling the feeding of sheets through the sheet transfer apparatus and a sensor for sensing the lead edge and the trailing edge of the sheet traveling thereby. The controller cooperates with the sensor and the mechanism to engage the mechanism with the driver at a position on the sheet relative to the lead edge and the trailing edge to adjust the space between adjacent sheets. The first sheet of the set is engaged by the sheet at a position adjacent the trailing edge and the last sheet of the set is engaged by the sheet at a position adjacent the lead edge, so that the space between the last sheet of the first set and the first sheet of the second set is greater than the space between adjacent sheets of a set of sheets so that additional time is available for the finisher to process the set of sheets in the finisher.

In accordance with yet another aspect of the present invention, there is provided a method for feeding sheets from a printing machine in which the sheets travel at a first translational speed to a finishing device in which the sheets travel at a second translational speed to form a set of sheets. The method includes the steps of identifying the sheets within each of set of sheets as they exit the printing machine. accelerating the sheets within each of set of sheets from the first translational speed to the second translational speed forming a finishing device interdocument gap between adjacent sheets upon obtaining the second translational speed, and controlling the length of the interdocument gap to assist the finishing device in performing its function.

For a general understanding of the present invention, as well as other aspects thereof, reference is made to the following description and drawings, in which like reference numerals are used to refer to like elements, and wherein.

While the present invention will be described with a reference to preferred embodiments thereof, it will be understood that the invention is not to be limited to these preferred embodiments. On the contrary, it is intended that the present invention cover all alternatives, modifications, and equivalents as may be included within the spirit and scope of the invention as defined by the appended claims. Other aspects and features of the present invention will become apparent as the description proceeds.

Figure 1:
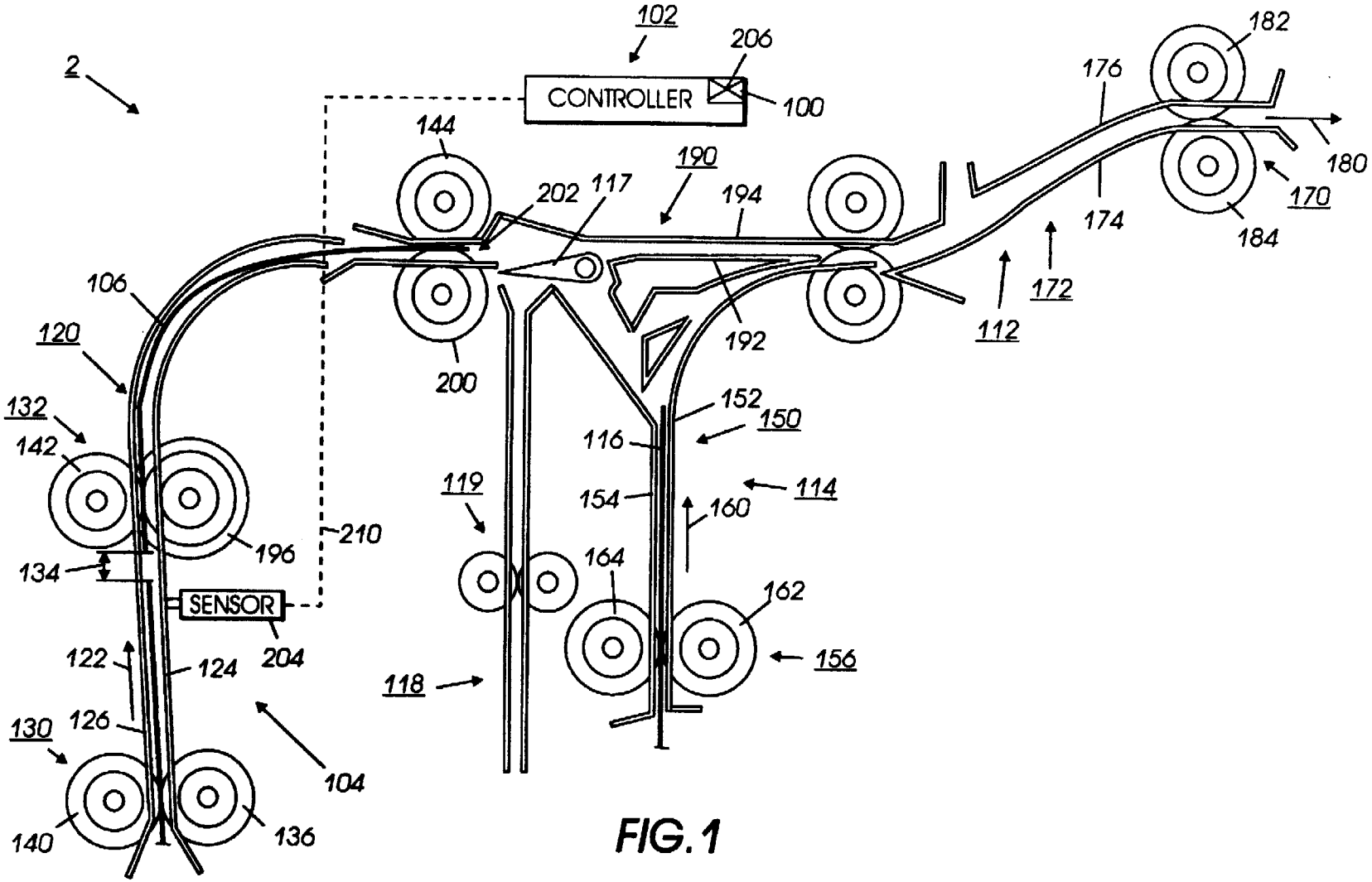
FIG. 1 is schematic elevation view of a sheet transfer apparatus including adaptive speed up and delay according to the present invention for transferring the sheets from a first sheet feeding apparatus to a second sheet feeding apparatus printing apparatus.

Inasmuch as the art of electrostatographic processing is well known, the various processing stations employed in a typical electrostatographic copying or printing machine of the present invention will initially be described briefly with reference to FIG. 1. It will become apparent from the following discussion that the paper feeding system of the present invention is equally well suited for use in a wide variety of other electrophotographic or electronic printing systems, as for example, ink jet, ionographic, laser based exposure systems, etc.

Figure 6:
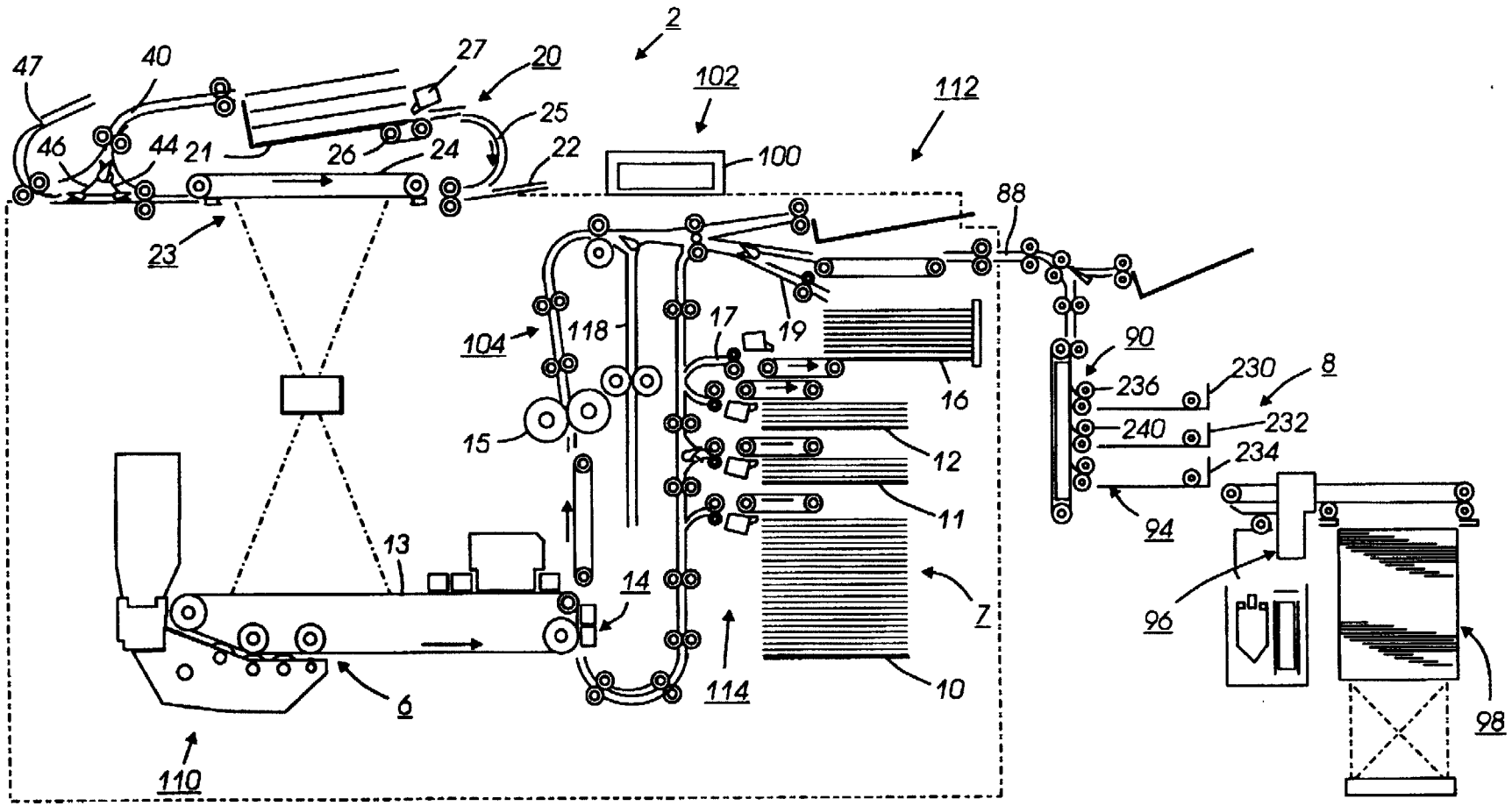
FIG. 6 is a schematic elevational view of a printing machine incorporating the sheet transfer apparatus including adaptive speed up and delay according to the present invention.

In FIG. 6, there is shown, in schematic form, an exemplary electrophotographic copying system 2 for processing, printing and finishing print jobs in accordance with the teachings of the present invention. For purposes of explanation, the copying system 2 is divided into a xerographic processing or printing section 6, a sheet feeding section 7, and a finishing section 8. The exemplary electrophotographic copying system 2 of FIG. 6 incorporates a recirculating document handler (RDH) 20 of a generally known type, which may be found, for example, in the well known Xerox Corporation model "1075", "5090" or "5100" duplicators. Such electrostatographic printing systems are illustrated and described in detail in various patents cited above and otherwise, including U.S. Pat. No. 4,961,092, the principal operation of which may also be disclosed in various other xerographic or other printing machines.

A printing system of the type shown herein is preferably adapted to provide, in a known manner, duplex or simplex collated print sets from either duplex or simplex original documents circulated by a document handler. As is conventionally practiced, the entire document handler unit 20 may be pivotally mounted to the copier so as to be liftable by an operator for alternative manual document placement and copying. In this manner, the exemplary printing system or apparatus 2 is designed to receive input documents as manually positioned on an optically transparent platen or automatically positioned thereon via a document handler, such as a recirculating document handler (RDH) 20, via a document handler input tray 21 or a document feeder 22.

The RDH 20 operates to automatically transport individual registered and spaced document sheets into an imaging station 23, platen operatively associated with the xerographic processing section 6. A platen transport system 24 is also provided, which may be incrementally driven via a non-slip or vacuum belt system controlled by a system controller 100 for stopping the document at a desired registration (copying) position in a manner taught by various references known in the art.

The RDH 20 has a conventional "racetrack" document loop path configuration, which preferably includes generally known inverting and non-inverting return recirculation paths for transporting original input documents back to the RDH loading and restacking tray 21. An exemplary set of duplex document sheets is shown stacked in this document tray 21. For clarity, the illustrated document and copy sheets are drawn here with exaggerated spacing between the sheets being stacked; in actual operation, these stacked sheets would be directly superposed upon one another. The RDH 20 may be a conventional dual input document handler, having an alternative semiautomatic document handling (SADH) side loading slot 22. Documents may be fed to the same imaging station 23 and transported by the same platen transport belt 24 from either the SADH input 22 at one side of the RDH 20, or from the regular RDH input, namely the loading or stacking tray 21, situated on top of the RDH unit. While the side loading slot 22 is referred to herein as the SADH feeding input 22, this input feeder is not limited to semi-automatic or "stream feed" document input feeding, but is also known to be usable for special "job interrupt" insert jobs. Normal RDH document feeding input comes from the bottom of the stack in tray 21 through arcuate, inverting RDH input path 25 to the upstream end of the platen transport 24. Input path 25 preferably includes a known "stack bottom" corrugated feeder-separator belt 26 and air knife 27 system including, document position sensors (not shown), and a set of turn baffles and feed rollers for inverting the incoming original documents prior to imaging.

Document inverting or non-inverting by the RDH 20 is further described, for example, in U.S. Pat. Nos. 4,794,429 or 4,731,637, among others. Briefly, input documents are typically exposed to a light source on the platen imaging station 23, or fed across the platen without being exposed, after which the documents may be ejected by the platen transport system 24 into downstream or off-platen rollers and further transported past a gate or a series of gates and sensors. Depending on the position of these gates, the documents are either guided directly to a document output path and then to a catch tray, or, more commonly, the documents are deflected past an additional sensor, and into an RDH return path 40. The RDH return path 40 provides a path for leading the documents back to tray 21 so that a document set can be continually recirculated. This RDH return path 40 includes reversible rollers to provide a choice of two different return paths to the RDH tray 21: a simplex return path 44 which provides sheet or document inversion or a reversible duplex return path 46 which provides no inversion, as will be further explained. For the duplex path 46, the reversible rollers are reversed to reverse feed the previous trail edge of the sheet back into the duplex return path 46 from an inverter chute 47. This duplex return path 46 provides for the desired inversion of duplex documents in one circulation as they are returned to the tray 21, for copying opposite sides of these documents in a subsequent circulation or circulations, as described in the above cited art. Typically, the RDH inverter and inversion path 46, 47 are used only for documents loaded in the RDH input tray 21 and for duplex documents. In normal operation, a duplex document has only one inversion per circulation (occurring in the RDH input path 24). By contrast, in the simplex circulation path there are two inversions per circulation, one in each of the paths 24 and 44, whereby two inversions per circulation is equivalent to no inversion such that simplex documents are returned to tray 21 in their original (face up) orientation via the simplex path 44.

The entire stack of originals in the RDH tray 21 can be recirculated and copied to produce a plurality of collated copy sets. In addition, the document set or stack may be recirculated through the RDH any number of times in order to produce any desired number of collated duplex print sets, that is, collated sets of duplex copy sheets, in accordance with various instruction sets known as print jobs which can be programmed into a controller 100, to operator which will be described.

Since the copy or print operation and apparatus of the present invention is well known and taught in numerous patents and other published art, the system will not be described in detail herein. Briefly, blank or preprinted copy sheets are conventionally provided by sheet feeder section 7, whereby sheets are delivered from a high capacity feeder tray 10 or from auxiliary paper trays 11 or 12 for receiving a copier document image from photoreceptor 13 at transfer station 14. In addition, copy sheets can be stored and delivered to the xerographic processing section 6 via auxiliary paper trays 11 or 12 which may be provided in an independent or stand alone device coupled to the electrophotographic printing system 2. After a developed image is transferred to a copy sheet, an output copy sheet is delivered to a fuser 15, and further transported to finishing section 8 (if they are to be simplex copies), or, temporarily delivered to and stacked in a duplex buffer tray 16 if they are to be duplexed, for subsequent return (inverted) via path 17 for receiving a second side developed image in the same manner as the first side. This duplex tray 16 has a finite predetermined sheet capacity, depending on the particular copier design. The completed duplex copy is preferably transported to finishing section 8 via output path 88. An optionally operated copy path sheet inverter 19 is also provided.

Output path 88 is directly connected in a conventional manner to a bin sorter 90 as is generally known and as is disclosed in commonly assigned U.S. Pat. No. 3,467,371 incorporated in its entirety by reference herein. Bin sorter 90 includes a vertical bin array 94 which is conventionally gated (not shown) to deflect a selected sheet into a selected bin as the sheet is transported past the bin entrance. An optional gated overflow top stacking or purge tray may also be provided for each bin set. The vertical bin array 94 may also be bypassed by actuation of a gate for directing sheets serially onward to a subsequent finishing station. The resulting sets of prints are then discharged to finisher 96 which may include a stitcher mechanism for stapling print sets together and/or a thermal binder system for adhesively binding the print sets into books. A stacker 98 is also provided for receiving and delivering final print sets to an operator or to an external third party device.

All document handler, xerographic imaging sheet feeding and finishing operations are preferably controlled by a generally conventional programmable controller 100. The controller 100 is additionally programmed with certain novel functions and graphic user interface features for the general operation of the electrostatographic printing system 2 and the dual path paper feeder of the present invention. The controller 100 preferably comprises a known programmable microprocessor system, as exemplified by the above cited and other extensive prior art (i.e., U.S. Pat. No. 4,475,156, and its references), for controlling the operation of all of the machine steps and processes described herein, including actuation of the document and copy sheet feeders and inverters, gates, etc. As further taught in the references, the controller 100 also conventionally provides a capability for storage and comparison of the numerical counts of the copy and document sheets, the number of documents fed and recirculated in a document or print set, the desired number of copy sets, and other functions which may be input into the machine by the operator through an input keyboard control or through a variety of customized graphic user interface screens. Control information and sheet path sensors (not shown) are utilized to control and keep track of the positions of the respective document and copy sheets as well as the operative components of the printing apparatus via their connection to the controller. The controller 100 may be conventionally connected to receive and act upon jam, timing, positional and other control signals from various sheet sensors in the document recirculation paths and the copy sheet paths. In addition, the controller 100 can preferably automatically actuate and regulate the positions of sheet path selection gates, including those gates associated with the dual path paper feeder, depending upon the mode of operation selected by the operator and the status of copying in that mode.

It shall be understood from the above description that multiple print jobs, once programmed, are scanned and printed and finished under the overall control of the machine controller 100. The controller 100 controls all the printer steps and functions as described herein, including imaging onto the photoreceptor, paper delivery, xerographic functions associated with developing and transferring the developed image onto the paper, and collation of sets and delivery of collated sets to the binder or stitcher, as well as to the stacking device 98. The printer controller 100 typically operates by initiating a sequencing schedule which is highly efficient in monitoring the status of a series of successive print jobs to be printed and finished in a consecutive fashion. This sequencing schedule may also utilize various algorithms embodied in printer software to introduce delays for optimizing particular operations.

Turning now to the specific example of the invention, as disclosed herein, and in particular as illustrated in FIG. 1, sheet transfer apparatus 102 is shown. The sheet transfer apparatus 102 is connected to first sheet feeding apparatus 104 for feeding copy sheets 106 from processing station 110 (see FIG. 6). Referring again FIG. 1, the sheet transfer apparatus 102 is further connected to a second sheet feeding apparatus 112 which passes sheets from the sheet transfer apparatus 102 to the finishing section 8 (see FIG. 6).

An insert feed assembly 114 may also be connected to the sheet transfer apparatus 102. The insert feed assembly 114 is used to transfer insert 116 from the auxiliary paper tray 11 or auxiliary paper tray 12 (see FIG. 6).

Referring again to FIG. 1, the copying system 2 preferably also includes an inverter 118 for inverting the copy sheet 106. Any suitable, durable mechanism such as lever 117 may be used to divert sheets to the inverter 118 for inversion thereof. Any suitable, durable mechanism may be used to urge the sheet 106 into and out of the inverter 118, for example feed roll assembly 119 similar to feed roll assembly 130 may be used.

The first sheet feeding apparatus 104 includes a xerographic exiting baffle assembly 120 within which the sheets 106 are traversed in the direction of arrow 122. The exiting baffle includes an internal baffle 124 and an external baffle 126. The baffles 124 and 126 may be made of any suitable durable material such as sheet metal. The sheets 106 progress through the first sheet feeding apparatus 104 in the direction of arrow 122 being driven by a first xerographic feed roll assembly 130. The first sheet feeding apparatus 104 may also include a second xerographic feed roll assembly 132 and may also include further feed roll assemblies (not shown). The feed roll assemblies 130 and 132 drive the sheet 106 at a velocity $V_1$ equal to the process speed of the processing station 110 (see FIG. 6).

The velocity $V_1$ to accommodate a copy machine with a process speed of 120 cpm and having an interdocument gap 134 between adjacent sheets of approximately one inch, provides for a translational speed $V_1$ of approximately 486 millimeters per second. The first xerographic feed roll assembly 130 typically includes a drive roll 136 and a driven roll 140 with the copy sheet being positionable between the peripheries of the rolls 136 and 140. Likewise, the second xerographic feed roll assembly 132 includes a one way driving mechanism 196 and a driven roll 142. The driving mechanism 196 includes a one way clutch for permitting the sheet 106 to be driven in the direction of arrow 122 at a speed greater than that speed provided by the driving mechanism 196.

The insert feed assembly 114 typically includes an insert baffle assembly 150 for guiding inserts 116 from the auxiliary paper trays 11 or 12 to the sheet transfer apparatus 102. The insert baffle assembly 150 includes an inner baffle 152 and an outer baffle 154. The insert feed assembly 114 also includes an insert feed roll assembly 156 for feeding the inserts 116 at a velocity $V_2$ along the direction of arrow 160. The insert feed roll assembly 156 includes a drive roll 162 and a driven roll 164.

The printing apparatus also includes an output feed roll assembly 170 for guiding the sheets 106 and the inserts 116 toward the finishing section 8 (see FIG. 6). The output feed roll assembly includes a output baffle assembly 172 for guiding the sheets along the output feed roll assembly 170. The output baffle assembly 172 includes an inner baffle 174 and an outer baffle 176. The sheets 106 as well as the inserts 116 are driven in the direction of arrow 180. The output feed roll assembly 170 includes a drive roll 182 and a driven roll 184. Sheets 106 and inserts 116 are driven in the direction of arrow 180 within the output feed assembly 170 with a velocity $V_2$ which is equal to the velocity $V_2$ of sheet 106 exiting the insert feed assembly 114.

The velocity $V_2$ of the output feed assembly 170 on the insert feed assembly 114 represents the speed of the finishing section 8 (see FIG. 6). As stated earlier, the finishing section 8 (see FIG. 6) progresses at a much higher velocity $V_2$ than velocity $V_1$ of the processing station 110. For example, for a copying machine with a productivity of 120 pages per minute, and the velocity $V_1$ of 486 millimeters per second, may have a finishing velocity $V_2$ of approximately 1556 millimeters per second, which is approximately three and one half times as fast as the speed of the sheets 106 within the processing station 110. This increased velocity is to provide time for the placement of the sheets within the bin sorter 90 and/or to provide time for the stapling or binding within the finisher 96.

The sheet transfer apparatus 102 performs at least three functions: to transfer the sheets 106 from the processing station 110; to transfer the insert sheets 116 from the auxiliary paper trays to the output feed assembly 117; and to accelerate the sheets within the first sheet feeding apparatus 104 from velocity $V_1$ to the velocity $V_2$ of the finishing section 8.

Referring again to FIG. 1, the sheet transfer apparatus 102 includes a transfer baffle assembly 190 for guiding the sheet 106 through the transfer apparatus 102. The transfer baffle assembly includes an inner baffle 192 as well as an outer baffle 194. The sheet transfer apparatus 102 further includes an accelerating mechanism 200 for accelerating the sheets 106 from the first velocity $V_1$ to the second velocity $V_2$ and driven roll 144 for providing a back up support to assist the accelerating mechanism 200 in driving the sheet 106.

To avoid excessive wear on the accelerating mechanism 200, the sheets 106, and the driving mechanism 196, the accelerating mechanism 200 cooperates with the driving mechanism 196 to individually accelerate each sheet 106 from velocity $V_1$ to velocity $V_2$. Therefore, the accelerating mechanism 200 accelerates each sheet 106 from a velocity $V_1$ to a velocity $V_2$. It is thus necessary to know the position of each sheet 106 relative to nip 202 between the driven roll 144 and the accelerating mechanism 200 so that the accelerating mechanism 200 may be accelerated from a velocity $V_1$ to velocity $V_2$ in a timed relationship with the passage of each sheet 106 by the nip 202. The same sheet 106 that is present in the nip 202 will be at least some of the time be located in the nip between the driven roll 142 and the driving mechanism 196.

A sensor 204 may be used in conjunction with a timer 206 within controller 100 to indicate the position of each sheet 106 relative to the nip 202. For convenience, the sensor 204 is positioned spaced from the nip 202 so that a location for the sensor 204 may be more easily provided. The sensor 204 is any suitable durable sensor capable of responding within a very short period of time to accommodate the rapid transfer of sheets 106 past the sensor 204. For example, such a sensor 204 may include a light emitting diode or a laser. Such sensors are available from Optec Co., Carrolton, Tex. The sensor 204 is electrically connected by conduit 210 to controller 100.

Controller 100 is further electrically connected to accelerating mechanism 200 and serves to send a signal to the mechanism 200 to cause the accelerating mechanism 200 to selectively accelerate the sheets 106 from a velocity $V_1$ to velocity $V_2$.

Figure 2A:
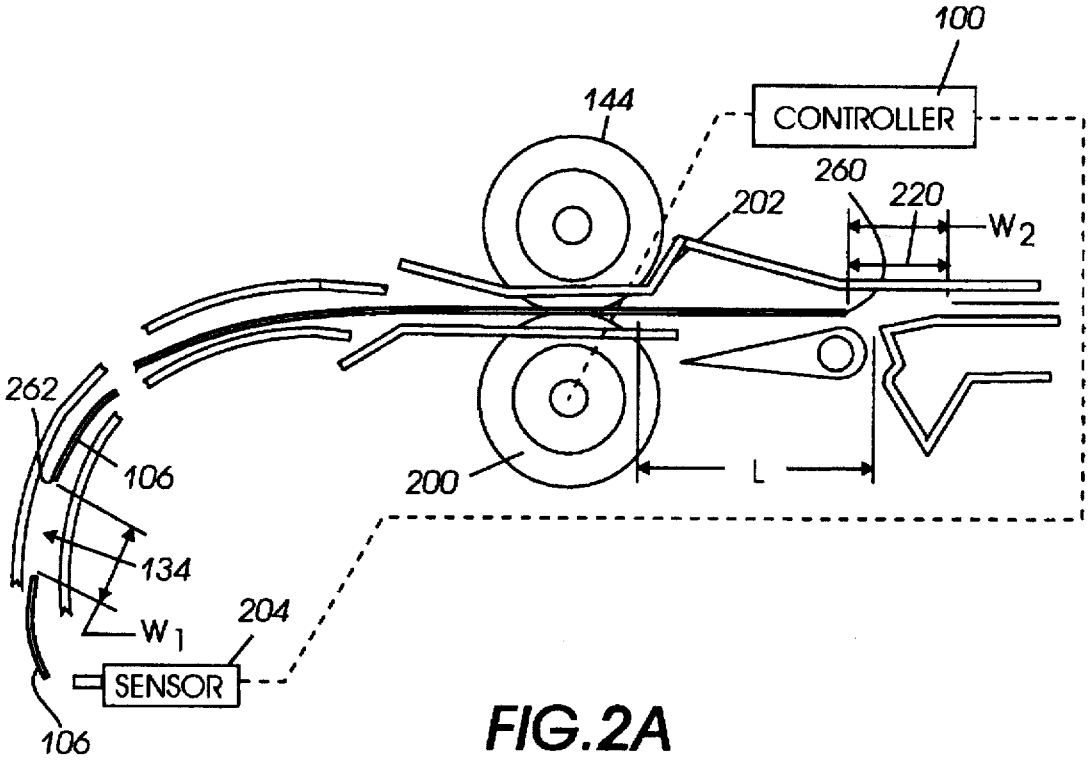
FIG. 2A is a partial schematic elevational view of sheet transfer apparatus of FIG. 1 showing in greater detail a clutch for performing the adaptive speed up and delay according to the present invention.
Figure 2B:
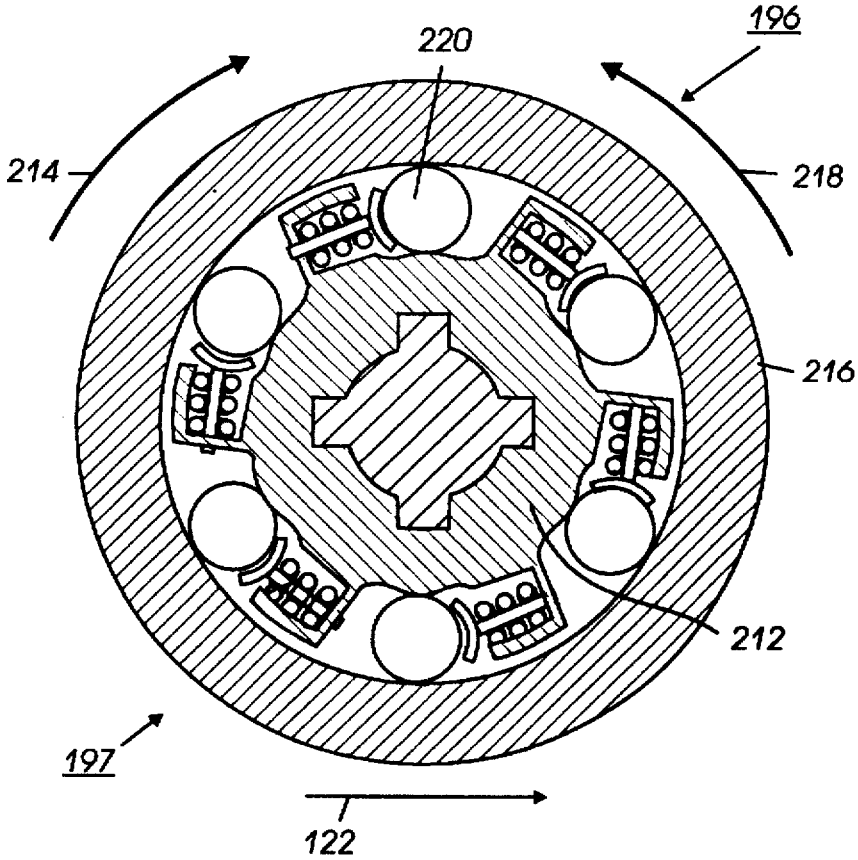
FIG. 2B is an elevational view of the overriding clutch for use with adaptive speed up and delay clutch of FIG. 2A.

Referring now to FIG. 2B, the driving mechanism 196 is shown in greater detail. The driving mechanism 196 includes a driving means (not shown) and a clutch 197 preferably in the form of an overrunning or one way clutch. For example, the clutch 197 includes an internal driver 212 rotating in the direction of arrow 214 by the driving means surrounded by a driven ring 216. Rollers 220 separate internal drive 212 from ring 216 so that the driving mechanism 196 is rotated in direction of arrow 214 by the driving means to drive the sheet 106 at velocity $V_1$. When, however, accelerating mechanism 200 drives sheet 106 at a velocity greater than $V_1$, the driven ring 216 rotates in direction of arrow 218 permitting driven ring 216 to rotate freely in direction of arrow 218. One way clutch 197 may be any suitable clutch, i.e. such a clutch is manufactured by INA Bearing Co., Inc., Fort Mill, S.C.

Referring now to FIG. 2A, the accelerating mechanism 200 is shown in greater detail. Mechanism 200 may be any suitable mechanism capable of providing a variety of velocities from velocity $V_1$ to velocity $V_2$. Preferably, the mechanism 200 may rapidly accelerate from velocity $V_1$, $V_2$, such that the velocity change from velocity $V_1$ to velocity $V_2$ can occur within length L of the paper. For a mechanism 200 that provides for constant acceleration from velocity $V_1$ to velocity $V_2$ within the length of the paper, for a paper with a length L of 8 and ½ inches and a document gap 134 with a width $W_1$ of approximately one half an inches, the sheet 106 at the nip 202 has an average velocity of about 1,550 mm per second. At the speed of 1,000 millimeters per second, the acceleration of the mechanism 200 must occur within 241 milliseconds. The applicant has found that a mechanism 200, for example, in the form of a mechanical clutch, such as a clutch that is electromechanical having a servo engagement, i.e. a clutch model CBJ, available from Deltran Co., Buffalo, N.Y., has an acceleration time considerably less than the required 215 milliseconds.

Figure 3:
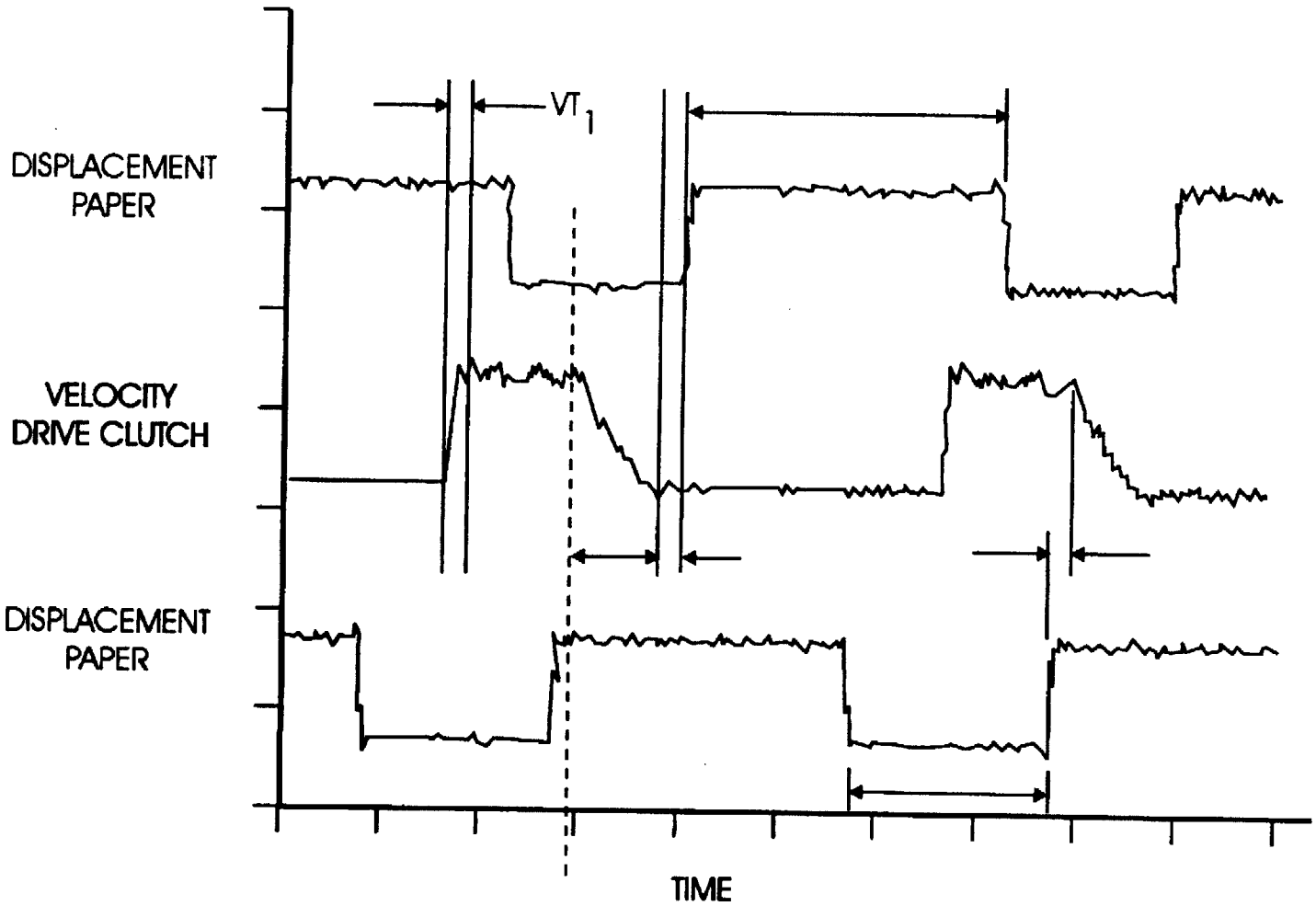
FIG. 3 is a first graph of the interdocument gap between the sheet in a sheet transfer apparatus including adaptive speed up and delay according to the present invention.
Figure 4:
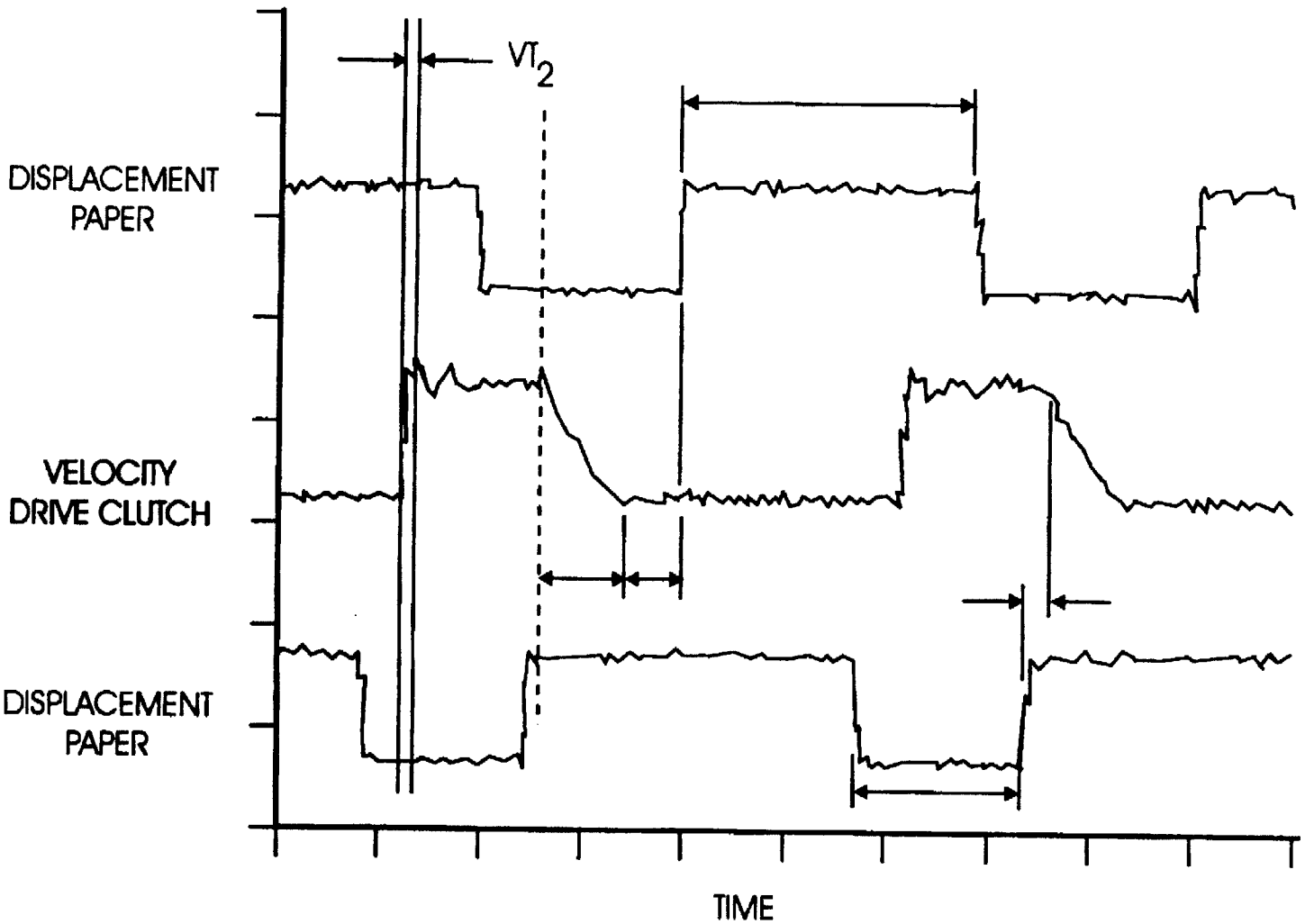
FIG. 4 is a second graph of the interdocument gap between the sheets in a sheet transfer apparatus including adaptive speed up and delay according to the present invention.

Referring now to FIGS. 3 and 4, applicant has plotted the angular velocity of the mechanism 200 as it accelerates from velocity $V_1$ to velocity $V_2$. Applicant has found that the mechanism 200 was able to accelerate from velocity $V_1$ to velocity $V_2$ within a time $VT_1$ of 0.015 seconds to velocity $VT_2$ of 0.020 seconds. Therefore, the mechanism 200 may accelerate within approximately 20 milliseconds much quicker than the 216 milliseconds required and available within the length of an 8½ by 11" sheet of paper.

Referring again to FIG. 2A, the acceleration of the sheets 106 through the mechanism 200 provides for a finishing document gap 220 which has a width $W_2$ which is significantly wider than width $W_1$ of interdocument gap 134 within the processing station 100. For a velocity $V_2$ approximately three times the velocity $V_1$, the finishing interdocument gap 220 within the finisher has a width $W_2$ of approximately twelve inches.

Referring again to FIG. 6, the interdocument gap provides for time for the sheets 106 to be consecutively placed within bin sorter 90. Bin sorter 90 includes not only first bin 230 but a second bin 232 and a third bin 234. When the last sheet of a first set of documents is placed within first bin 230, the next sheet which forms the first sheet of the second set of documents must be positioned in second bin 232. First bin mechanism 236 and second bin mechanism 240 are thereby repositioned to provide for the sheet 106 to enter into second bin 232 rather than first bin 230. The movement of the first and second bin mechanisms 236 and 240 take a discrete period of time. A skip pitch earlier described or a multitude of skip pitches may be required to account for the time period for the mechanisms 236 and 240 to react. The time for the skip pitches represents a loss in productivity for the printing apparatus. According to the present invention, the applicant has discovered that interdocument gap 220 rather than remaining constant from sheet to sheet, may be varied to provide for a interdocument gap 220 which is larger between the last sheet of a first set of sheets and the first sheet of a subsequent set of sheets such that the interdocument gap between sheets of adjacent sets of sheets may be greater than the gap between adjacent sheets within a set of sheets. This greater interdocument gap between sets of sheets provides for additional time for the mechanisms 236 and 240 to react. Such a greater interdocument gap between sets of sheets may reduce the number of skipped pitches between sequential sets of sheets or may entirely obviate the need for skipped pitches between subsequent sets of sheets.

Figure 5:
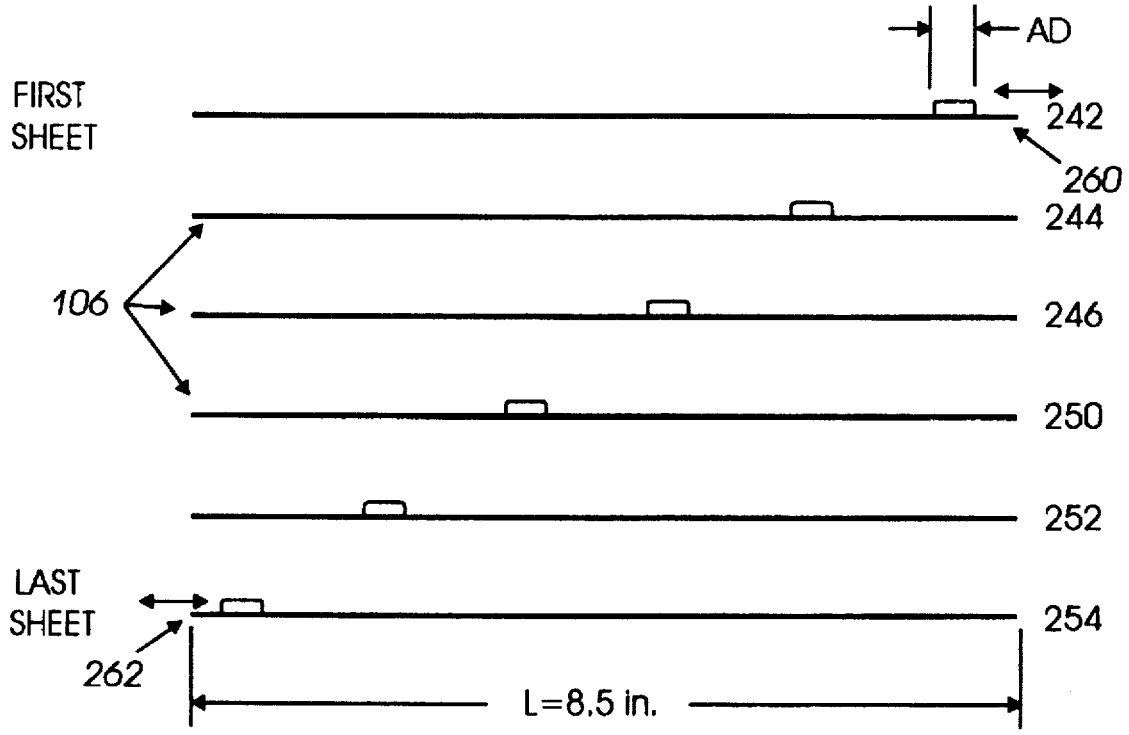
FIG. 5 is a schematic elevational view of the sheets within a set of sheets of a printing machine showing the roller acceleration path along the respective sheets according to the present invention.

Referring now to FIG. 5, an exemplary operation of the mechanism according to the present invention is shown. Sheets 106 are shown in sequential relationship with first sheet 242 placed on top followed by second sheet 244 below first sheet 242 and third sheet 246 placed below second sheet 244. Sequentially sheet 250, the fourth sheet is placed below sheet 246, fifth sheet 252 is placed below the fourth sheet 250 and sixth sheet 254 is placed below sheet 252. The sheets are shown with a length L which length L is approximately 8 and ½ inches for normal 8 and ½ by 11 inch paper.

As earlier stated, and referring to FIGS. 3 and 4, applicant has found that the acceleration by the mechanism 200 may be accomplished within approximately 0.020 seconds.

As stated earlier and referring to FIG. 2, a sheet 106 may pass from leading edge 260 to trailing edge 262 across nip 202 within approximately 0.216 seconds.

Referring again to FIG. 5, for a accelerating time of 0.020 seconds, a corresponding distance AD along the sheets 106 during which sheet 106 is accelerated within the nip, may be determined. The 0.020 seconds would represent only a portion of the approximately 0.200 seconds in which the paper 106 is within the nip 202. Applicant has found that the first sheet 242 of a set of sheets is preferably accelerated near lead edge 260 of the paper while the last sheet 254 is accelerated near the trailing edge 262 of the paper 254. Preferably, the second through fifth sheets 244–252 have an acceleration distance AD which are equally spaced along the length of the sheets 106 to provide for a uniform interdocument gap between sheets within a set of sheets.

By providing an acceleration of the sheets within the nip of the sheet transfer apparatus such that the first sheet of a set of sheets is accelerated near the lead edge of the first sheet of a set of sheets and the last sheet of a set of sheets is accelerated near the trailing edge of the last sheet of a set of sheets, the interdocument gap between sets of sheets may be made greater than the interdocument gap between sheets within a set of sheets. Such an operation provides for a greater interdocument gap between sets of sheets providing for more time for the finisher to perform its function and may reduce the amount of skipped pitches required for the operation of the machine and thereby increase the productivity of the machine.

By providing for greater interdocument gap between sheets of different sets of sheets, the finisher may have additional time to perform operations between sets of sheets.

It is, therefore, evident that there has been provided, in accordance with the present invention, an electrostatographic copying apparatus that fully satisfies the aims and advantages of the invention as hereinabove set forth. While the invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. A printing apparatus, including a processing section for transferring a developed image onto a copy sheet and a finishing section for receiving plural copy sheets to generate a print set, comprising:

a first sheet feeding apparatus associated with the processing section for feeding the sheets through the processing station at a first translational speed;

a second sheet feeding apparatus associated with the finishing section for feeding the sheets to the finishing section at a second translational speed;

a sheet transfer apparatus for transferring the sheets from said first sheet feeding apparatus to said second sheet feeding apparatus, for changing the speed of the sheets from the first translational speed to the second translational speed and for positioning adjacent sheets in the second feeding apparatus in a spaced apart relationship therebetween defining a space between adjacent sheets; and a controller operably connected to the sheet transfer apparatus for controlling the feeding of sheets through the sheet transfer apparatus to permit the space to be selectively determined.

2. The printing apparatus of claim 2, wherein the first translational speed is less than the second translational speed.

3. The printing apparatus of claim 2, wherein said sheet transfer apparatus comprises a mechanism for accelerating the sheets from the first translational speed to the second translational speed, the mechanism cooperating with said second sheet feeding apparatus to position adjacent sheets in the second feeding apparatus.

4. The printing apparatus of claim 3, wherein said mechanism comprises a clutch.

5. The apparatus of claim 3, wherein the mechanism comprises a driver engaged with the paper for accelerating the sheets from the first translational speed to the second translational speed.

6. The apparatus of claim 3, wherein the driver comprises a roll in rolling contact with the sheet.

7. The apparatus of claim 4, wherein said mechanism further comprises a driver, said driver being driven by said clutch, said clutch having a first position engaged with said driver and a second position disengaged from said driver.

8. The apparatus of claim 7, further comprising a sensor for sensing the lead edge and the trailing edge of the sheet traveling thereby.

9. The apparatus of claim 8, wherein said controller cooperates with said sensor and said clutch to engage said clutch with said driver at a position on said sheet relative to said lead edge and said trailing edge to adjust the space between adjacent sheets.

10. The apparatus of claim 9:

wherein the first sheet of said set is engaged by said sheet at a position adjacent said trailing edge; and wherein the last sheet of said set is engaged by said sheet at a position adjacent said lead edge; so that the space between the last sheet of the first set and the first sheet of the second set is greater than the space between adjacent sheets of a set of sheets so that additional time is available for the finisher to process the set of sheets in the finisher.

11. A printing apparatus, including a processing section for transferring a developed image onto a copy sheet and a finishing section for receiving plural copy sheets to generate a print set, comprising:

a first sheet feeding apparatus associated with the processing section for feeding the sheets through the processing station at a first translational speed;

a second sheet feeding apparatus associated with the finishing section for feeding the sheets to the finishing section at a second translational speed, the first translational speed being less than the second translational speed;

a sheet transfer apparatus for transferring the sheets from said first sheet feeding apparatus to said second sheet feeding apparatus, for changing the speed of the sheets from the first translational speed to the second translational speed and for positioning adjacent sheets in the second feeding apparatus in a spaced apart relationship therebetween defining a space between adjacent sheets, said sheet transfer apparatus including a mechanism for accelerating the sheets from the first translational speed to the second translational speed, the mechanism cooperating with said second sheet feeding apparatus to position adjacent sheets in the second feeding apparatus, the mechanism including a driver engaged with the sheet for accelerating the sheet from the first translational speed to the second translational speed;

a controller operably connected to the sheet transfer apparatus for controlling the feeding of sheets through the sheet transfer apparatus; and a sensor for sensing the lead edge and the trailing edge of the sheet traveling thereby, said controller cooperating with said sensor and said mechanism to engage said mechanism with said driver at a position on said sheet relative to said lead edge and said trailing edge to adjust the space between adjacent sheets, the first sheet of said set being engaged by said sheet at a position adjacent said trailing edge and the last sheet of said set being engaged by said sheet at a position adjacent said lead edge, so that the space between the last sheet of the first set and the first sheet of the second set is greater than the space between adjacent sheets of a set of sheets so that additional time is available for the finisher to process the set of sheets in the finisher.

12. The printing apparatus of claim 11, wherein said mechanism comprises a clutch.

13. The apparatus of claim 12, wherein said mechanism further comprises a driver, said driver being driven by said clutch, said clutch having a first position engaged with said driver and a second position disengaged from said driver.

14. The apparatus of claim 13, wherein said driver comprises a roll in rolling contact with the sheet.

15. A method for feeding sheets from a printing machine in which the sheets travel at a first translational speed to a finishing device in which the sheets travel at a second translational speed to form a set of sheets, the method comprising the steps of:

identifying the sheets within each of set of sheets as they exit the printing machine;

accelerating the sheets within each of set of sheets from the first translational speed to the second translational speed;

forming a finishing device interdocument gap between adjacent sheets upon obtaining the second translational speed; and controlling the length of the interdocument gap to assist the finishing device in performing its function.

16. The method of claim 15, further comprising the step of locating at least one of the leading edge and the trailing edge of the sheet.

17. The method of claim 15, wherein the step of controlling the length comprises accelerating adjacent sheets at different respective locations on the sheet relative to the leading edge of the sheet.

18. The method of claim 15, wherein the step of controlling the length of the interdocument gap comprises shortening the gap between adjacent sheets of a set and lengthening the gap between the last sheet of the first set and the first sheet of the second set.

19. The method of claim 15, wherein the step of identifying the sheets comprises sensing at least one of the leading edge of the sheet and the trailing edge of the sheet.

20. The method of claim 15, wherein the step of controlling the length of the interdocument gap comprises selectively accelerating the sheets.

* * * * *